United States Patent [19]

Daniel

[11] 4,294,497

[45] Oct. 13, 1981

[54] COMBINED CARRYING CASE, DISPLAY DEVICE AND LECTERN

[76] Inventor: Robert A. Daniel, 455 Center St., Bridgewater, Mass. 02324

[21] Appl. No.: 178,085

[22] Filed: Aug. 14, 1980

[51] Int. Cl.[3] ..... A47B 27/00

[52] U.S. Cl. ..... 312/231; 312/196; 312/233

[58] Field of Search ..... 434/81, 84, 432; 248/455, 456, 457, 460; 312/231, 233, 196, DIG. 33

[56] References Cited

U.S. PATENT DOCUMENTS

| | | | |
|---|---|---|---|
| 275,882 | 4/1883 | Brownell | 312/231 |
| 591,574 | 10/1897 | Smith | 434/432 |
| 1,869,278 | 7/1932 | Ramelli | 248/455 |
| 4,047,309 | 9/1977 | Royko | 434/432 X |

*Primary Examiner*—Harland S. Skogquist

*Attorney, Agent, or Firm*—Wolf, Greenfield & Sacks

[57] ABSTRACT

A teacher's or lecturer's carrying case is provided with means to facilitate displays while lecturing and can be arranged in a number of configurations so as to serve as a carrying case, a display aid or a lectern.

5 Claims, 4 Drawing Figures

COMBINED CARRYING CASE, DISPLAY DEVICE AND LECTERN

BACKGROUND AND SUMMARY OF THE INVENTION

This invention relates to a multi-purpose portable device useable by teachers, lecturers or the like. The device is useable not only as a carrying case for lecture materials, etc., but also can be arranged in a number of different configurations so as to facilitate display of materials or to serve as a lectern for a lecturer. When used in its display mode, the device enables one to stand behind it while displaying material on the display face of the board without interfering with the audience's view of the display board, and in a manner which enables the lecturer to reach the display board so as to point to particular display material, or the like.

For example only, the device is particularly useful by art teachers where it is desirable for the entire class or audience to have a full, unobstructed view of a canvas of paper on which the art teacher may demonstrate. It is a common practice for an art teacher, when going from class to class, to carry a number of items including all of the artists' materials, an easel, lecture materials or the like. Typically, this is an awkward and time-consuming procedure and is inconvenient, particularly when there are but a few minutes to go from one class to the next. Moreover, even when the artist has set up in a new location using a conventional easel, his illustrations done on the easel usually will be obstructed at least in part to some of the audience or class. In some instances, a lecturer also might wish to carry a lectern which, of course, inconveniently adds to the bulk of the devices and materials he will carry.

With my invention, many of the foregoing difficulties and inconveniences are overcome. The device is in the form of a carrying case which is of generally upwardly tapering cross section, being relatively deep at its base and relatively narrow at its upper end. The device includes a bottom wall, a rear wall, a pair of approximately triangular or trapezoidal side walls and a relatively short front wall. A rectangular cover is hinged to the upper edge of the rear wall. When the device is closed, the cover rests on the downwardly and forwardly inclined edges of the side walls and the cover thus serves as a closure for the device. In addition, when the cover is closed, it serves as a display board which can hold paper or the like. Because of the upwardly tapering configuration of the case, the teacher or lecturer can stand behind the device and easily reach over its top to draw on or otherwise have access to the paper or other material on the cover. This enables the teacher to make illustrations on the board without interfering with the view of any part of the class or audience. In addition, the cover may be raised to an intermediate position so as to serve as a lectern. Means are provided for supporting the cover in this intermediate raised configuration.

A further feature of the invention is an extendable shelf which normally is stored inside the bottom of the case and defines a false bottom. A slot is formed along the face of the front wall to enable the shelf to be pulled out through the slot so as to extend forwardly. When the shelf is pulled out, it provides a convenient base for artist's materials such as paint jars, brushes and the like.

When the shelf is retracted, it defines a false bottom and an additional storage compartment in the case.

It is among the objects of the invention to provide an improved multipurpose case for use by teachers, lecturers or the like.

A further object of the invention is to provide a device of the type described which facilitates portability of all materials and which can be arranged in a display configuration as well as a lectern configuration.

Another object of the invention is to provide a device of the type described which enables a teacher or lecturer to have ready access to the front display region of the device while standing behind the device, thereby minimizing obstruction to the view of the class or audience.

The foregoing and other objects and advantages of the invention will be appreciated more fully from the following further description thereof, with reference to the accompanying drawings wherein.

DESCRIPTION OF AN ILLUSTRATIVE EMBODIMENT

Figure 1:
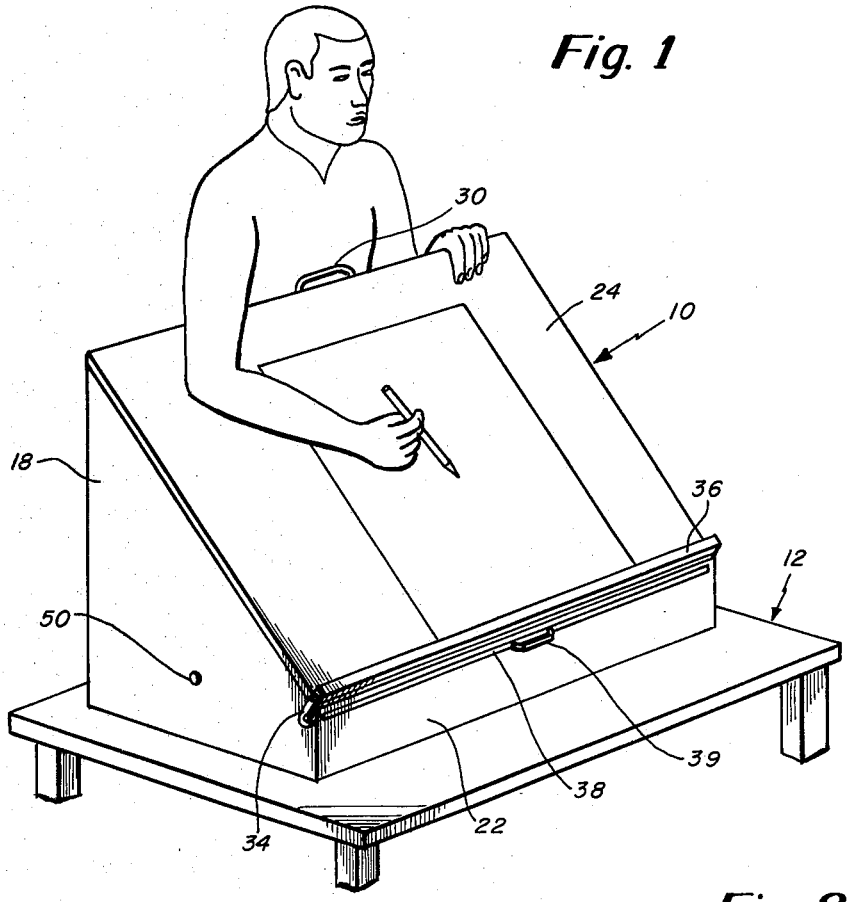
FIG. 1 is an illustration of the device in its closed configuration showing the manner in which the device may be used in its display mode.
Figure 2:
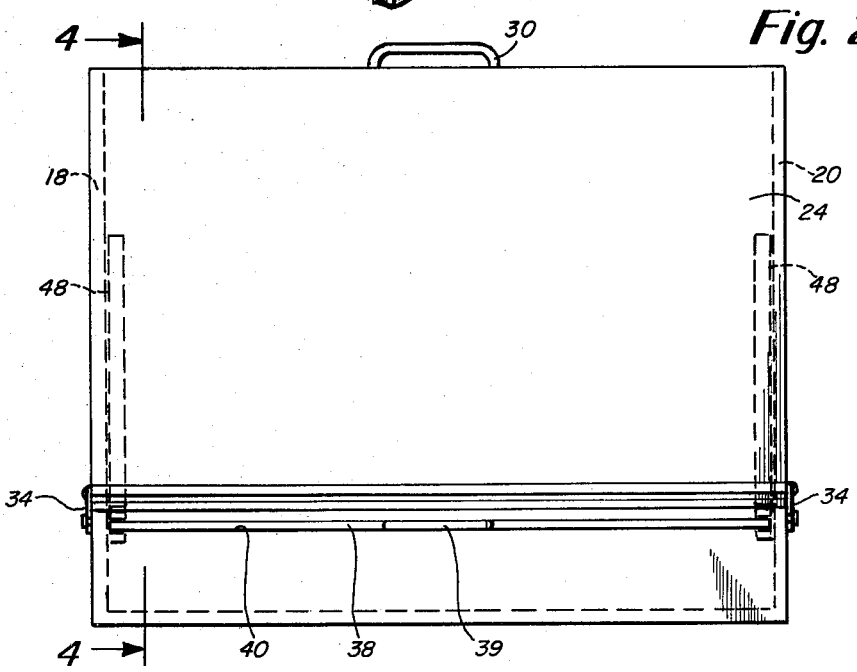
FIG. 2 is a front elevation of the device.
Figure 4:
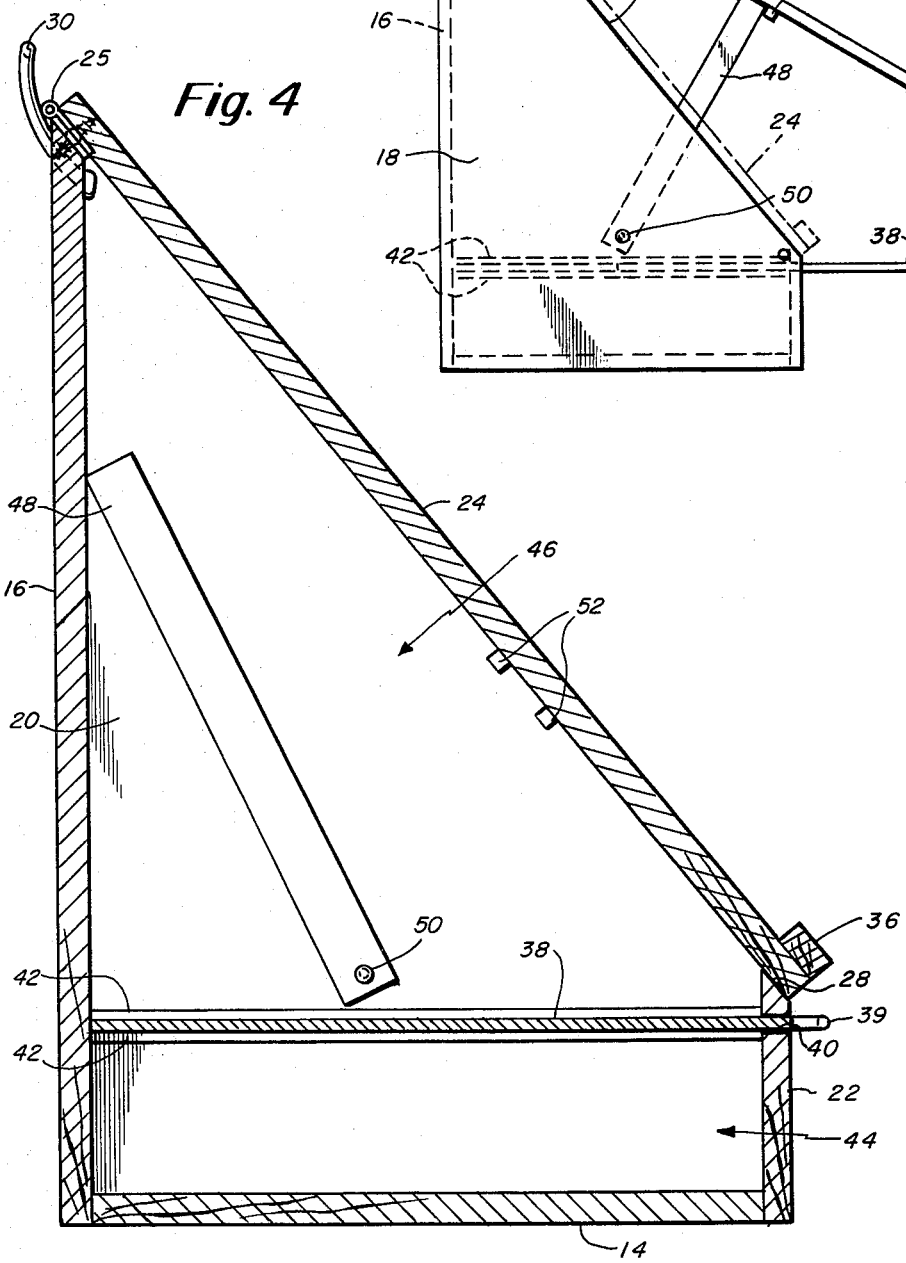
FIG. 4 is a sectional side elevation of the device as seen along the line 4—4 of FIG. 2.

FIG. 1 illustrates the device as it may be used in its display mode by a teacher or lecturer. The device 10 may be placed on a suitable support such as a table 12 so that the teacher may stand behind the device while displaying the front face to the class or audience. The case 10 may be formed from heavy-duty cardboard or the like. As shown in FIGS. 2 and 4, it includes a bottom wall 14, a rear wall 16 which extends upwardly to the full height of the device, a pair of triangular side walls 18, 20 and a relatively short front wall 22, all of which are connected together by any convenient means which will be apparent to those skilled in the art. The walls of the device may be made separately or the device may be cut from a single blank of heavy cardboard. A rectangular cover 24 is hinged to the upper edge of the rear wall 16 by a hinge 25 or flexible tape or other suitable means.

When the cover is closed, as illustrated in FIGS. 1 and 4, it rests on the downwardly and forwardly inclined edges 26 (See FIG. 3) of the triangular side walls 18, 20 as well as on the upper edge 28 of the short front wall 22. A carrying handle 30 is secured to or adjacent the upper end of the rear wall 16. A latching device 34 preferably is associated between a lower portion of the cover 24 and the side walls 18, 20 or wall 22 to secure the cover in place when the device is used as a carrying case. The latch 34 may be of any convenient form such as a pair of posts and wrap-around string. The lower edge of the cover 24 preferably is provided with a lip 36 which helps to hold the displayed material in place, as will be described.

The device also incorporates a retractable shelf 38 which is extendable forwardly and outwardly through a slot 40 formed transversely through the front wall 22. The depth of the shelf 38 is substantially equal to the depth of the case and, when in its retracted, stored configuration (FIG. 4) extends from the front wall 22 to the rear wall 16. The shelf 38 may be supported and guided by guide rails 42 secured to the interior of each of the side walls 18, 20. When in its retracted configuration, the shelf 38 defines a false bottom for the case, thereby defining the storage regions of the case into a lower region 44 and an upper storage region 46. The provision of separate upper and lower storage regions 44, 46 is desirable in that it can keep paper separated from paint or can be utilized to maintain separation of other items as desired. When the shelf 38 is pulled out through the slot 40, to its extended configuration illustrated in phantom in FIG. 3, it provides a convenient location for paints, brushes and the like when the device is in its display mode. The shelf 38 may be provided with a convenient handle 39 at its forward edge.

Figure 3:
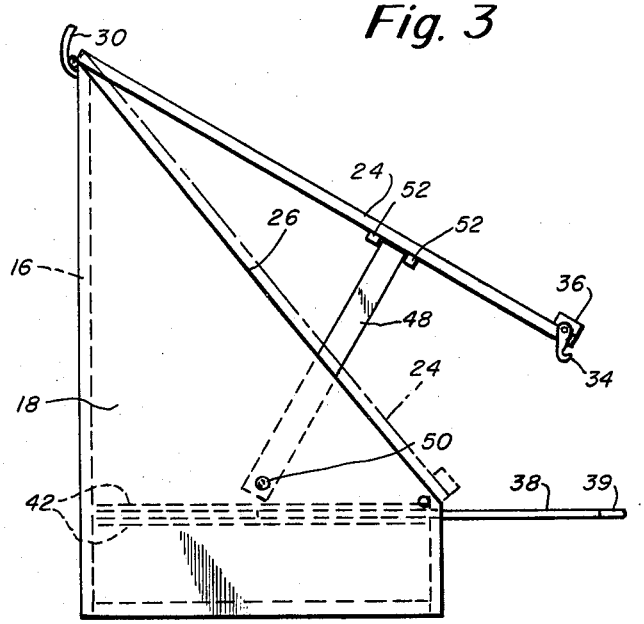
FIG. 3 is a side elevation of the device with the cover in its lectern position and the shelf in its extended position.

FIG. 3 illustrates the configuration of the cover when the device is used as a lectern. When used in this configuration, the rear wall 16 faces the audience and the cover 24 is raised to the position shown in solid in FIG. 3. In order to hold the cover 24 in this position, the device includes at least one and preferably two struts 48 associated with the side walls 18, 20. The struts are pivoted, at 50, to the lower region of the side walls 18, 20 and may be swung from a rearward, out-of-the-way position to a forward position in which the upper ends of the struts 48 provide support for the cover 24 in its intermediate, lectern configuration. The underside of the cover may be provided with retaining members 52 to receive the ends of the struts 48.

From the foregoing, it will be appreciated that the device provides a convenient and portable means for carrying a substantial number of items for ruse by a teacher, lecturer or the like and facilitates setting up of the device in a number of configurations as may be desired by the user. It should be understood, however, that the foregoing description of the invention is intended merely to be illustrative thereof and that other modifications and embodiments of the invention may be apparent to those skilled in the art without departing from its spirit.

Having thus described the invention, what I desire to claim and secure by Letters Patent is:

1. A multi-use carrying case, display and lectern device comprising:

a bottom wall;

an upwardly extending rear wall;

a relatively short front wall;

a pair of side walls, the side walls being tapered upwardly so as to present a narrowing and reduced width at their upper ends;

said walls being secured together to define a case configuration which, in cross section, tapers upwardly;

a rectangular cover extending downwardly along the front edge of each of the side walls and being arranged to cover fully the case, the cover being hinged at its upper end to the upper end of the rear wall;

a transversely extending slot formed in the short front wall;

a shelf defining a false bottom within the case, the shelf being extendable through the slot to provide a forwardly extending shelf on which materials may be supported;

guide means for guiding and supporting the shelf for movement between its retracted configuration in which it defines the false bottom for the case and its extended configuration in which it projects outwardly through the slot; and a carrying handle secured to the upper region of the device.

2. A device as defined in claim 1 wherein said shelf defines the interior of the case into an upper compartment and a lower compartment when the shelf is in its retracted configuration.

3. A device as defined in claim 2 further comprising:

means for supporting the cover in a partially opened configuration.

4. A device as defined in claim 3 wherein the means for supporting the cover in a partially opened configuration comprises:

at least one strut pivotally mounted to a side wall of the device and having a free end which is pivotable from a retracted configuration within the case to a configuration in which the free end extends forwardly and outwardly of the front of the case, the strut being constructed and arranged to engage and support the underside of the cover.

5. A device as defined in claim 1 further comprising a lip extending along the lower edge of the cover.

* * * * *